US006125562A

United States Patent [19]

Dodier et al.

[11] Patent Number: 6,125,562

[45] Date of Patent: Oct. 3, 2000

[54] METHOD FOR PRODUCING A SEALED CONNECTION BETWEEN THE HEATING BODY OF A SOLE PLATE OF IRON SOLE PLATE

[75] Inventors: Philippe Dodier, Sainte Foy les Lyon; Jean-Louis Brandolini, Saint Etienne, both of France

[73] Assignee: SEB S.A., Ecully, France

[21] Appl. No.: 09/297,556

[22] PCT Filed: Sep. 1, 1998

[86] PCT No.: PCT/FR98/01875

§ 371 Date: May 3, 1999

§ 102(e) Date: May 3, 1999

[87] PCT Pub. No.: WO98/11855

PCT Pub. Date: Mar. 11, 1999

[30] Foreign Application Priority Data

Sep. 2, 1997 [FR] France ..... 97 11098

[51] Int. Cl.[7] ..... D06F 75/38

[52] U.S. Cl. ..... 38/93

[58] Field of Search ..... 38/93, 88, 77.87; 156/145, 295, 292, 307.1, 307.7

[56] References Cited

U.S. PATENT DOCUMENTS

| | | | |
|---|---|---|---|
| 5,146,700 | 9/1992 | Prosser | 38/93 |
| 5,273,606 | 12/1993 | Greve et al. | 156/305 X |
| 5,907,916 | 6/1999 | Hahnewald et al. | 38/93 |
| 5,935,375 | 8/1999 | Nakazawa et al. | 156/295 X |
| 5,937,552 | 8/1999 | Hall | 38/93 |

FOREIGN PATENT DOCUMENTS

| | | |
|---|---|---|
| 267 838 | 5/1998 | European Pat. Off. . |
| 195 08 446 | 9/1996 | Germany . |
| 2 225 345 | 5/1990 | United Kingdom . |

*Primary Examiner*—Ismael Izaguirre
*Attorney, Agent, or Firm*—Pillsbury Madison & Sutro

[57] ABSTRACT

The heating element (1) is covered with a plate (2) constituting the ironing surface of the iron and comprising outlets for steam. The heating element (1) surface (6) designed to be covered by the plate (2) comprises a groove (7) extending at least on the whole periphery of the heating element (1). The method is characterised in that it consists in maintaining the heating element (1) flat, the surface (6) comprising the groove (7) facing upwards, pouring a resin (8) in the groove (7), applying the plate on the heating element (1) surface (6), turning the assembly such that the plate (2) faces downwards, to cause the resin (8) to flow in the groove (7) part adjacent to the plate (2).

13 Claims, 4 Drawing Sheets

METHOD FOR PRODUCING A SEALED CONNECTION BETWEEN THE HEATING BODY OF A SOLE PLATE OF IRON SOLE PLATE

TECHNICAL FIELD

The present invention concerns a process for producing a sealed connection between the heating body of a sole plate of a steam iron and a plate often called a cap constituting the pressing surface of the iron.

The invention is equally directed to the sole plate of a pressing iron produced by the above-cited process.

PRIOR ART

The heating body of the sole plate is generally made of aluminum by molding, the tubular heating resistance being embedded in the sole plate body.

The plate or cap of the sole plate is generally made of an aluminum sheet whose pressing surface is advantageously coated with a layer facilitating sliding of the iron, such as a layer of enamel.

This plate or cap has steam passage holes which communicate with the steam chamber of the iron produced above the heating body.

This cap must be fixed in a sealed manner to the heating body.

This fixation can be achieved by means of a layer of resin resistant to the heating temperature of the sole plate and applied between the parts in contact of the heating body and of the cap, for example by screen printing.

This process, which is satisfactory when the area of the contact surface between the heating body and the cap is substantial, and corresponds to the major part of the surface of the heating body, is insufficient when this area is substantially reduced.

SUMMARY OF THE INVENTION

The object of the present invention is to overcome the above drawback, by proposing a process permitting the production of a sealed connection between the heating body and the plate which is simple and economical to implement and which guarantees a particularly reliable sealed connection, in particular when the area of the contact surfaces between the heating body and the cap is small.

The invention is thus directed to a process for producing a sealed connection between the heating body of a sole plate of a steam iron and a plate constituting the pressing surface of said iron, the plate having steam outlet holes.

According to the invention, this process is characterized in that the side of the heating body intended to be covered by said plate comprises a groove extending at least along the entire periphery of said heating body, in that said heating body is held flat, the side having the groove being directed toward the top, resin is caused to flow into said groove, said plate is applied onto said side of the heating body, the assembly is turned over in a manner such that the plate is directed toward the bottom, in order to cause the resin to flow into the part of the groove adjacent to the plate.

The resin utilized can be a silicone resin which is resistant to the heating temperature (around 250° C.) of the iron sole plate.

When one turns over the assembly constituted by the heating body and the plate, the resin which has flowed into the groove comes to be applied onto the surface of the plate which covers the groove by constituting a ribbon having a predetermined thickness.

Advantageously, the turned over assembly is heated in a manner to accelerate or obtain hardening of the resin.

After hardening of the resin, a sealed and reliable connection is obtained between the heating body and the plate.

The invention is equally directed to the iron sole plate produced according to the process according to the invention.

According to the invention, each of the branches of said groove adjacent to respective longitudinal edges of the heating body are traversed by a series of conduits whose extremity adjacent to the bottom of said branch communicates by a channel with a steam chamber and of which the other extremity opens into a hole arranged in the plate applied onto the heating body.

By this fact, the resin which has flowed into said groove surrounds the extremity adjacent to the plate of each conduit and is in contact with the surface of the plate which covers the groove.

According to a preferred embodiment of the invention, the vapor passage holes arranged in the plate are prolonged toward the heating body by tubular parts formed in said plate, these latters being engaged and set into the conduits situated in the groove of the heating body.

BRIEF DESCRIPTION OF THE DRAWINGS

Other particularities and advantages will also appear in the description here below.

Of the attached figures, given by way of non-limiting example.

BEST MANNER OF CARRYING OUT THE INVENTION

Figure 1:
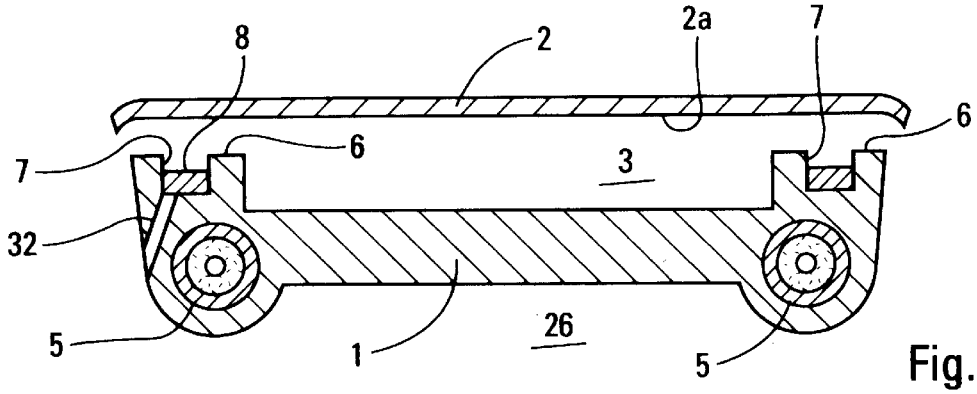
FIG. 1 is a schematic view in transverse cross-section of a heating body of a steam iron sole plate, after flow of a resin into the groove of the heating body.

There will be described with reference to FIGS. 1 and 2 the process for producing a sealed connection between heating body 1 of a steam iron soleplate and a plate or cap 2 constituting the ironing surface of the iron. Heating body 1 comprises a tubular heating resistance 5 which surrounds one (or several) steam chamber(s) 26 situated at the side of heating body 1 opposite to cap 2.

This plate 2 comprises (see FIGS. 3 to 7) steam outlet holes 4 formed in steam chamber 26.

According to the invention, the side 6 of heating body 1 intended to be covered by plate 2 comprises a groove 7 extending at least along all of the periphery of heating body 1.

Figure 2:
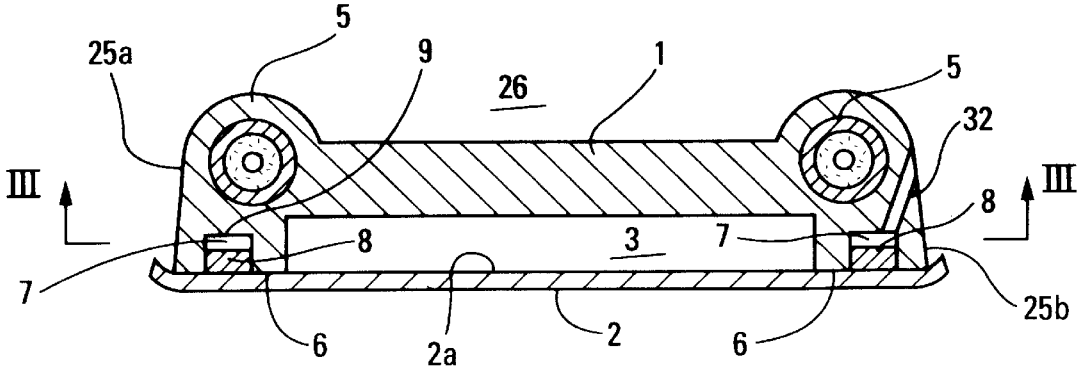
FIG. 2 is a view similar to that of FIG. 1, after application of the plate and turning of the assembly.

According to the process of the invention, heating body 1 is maintained flat, the side 6 comprising groove 7 being directed toward the top, as indicated in FIG. 1.

Then a resin 8 is poured into the groove 7, then plate 2 is applied onto side 6 of heating body 1 (see FIG. 1).

In the following step, illustrated in FIG. 2, the assembly is turned over in a manner such that plate 2 is directed toward the bottom in order to cause the resin 8 to flow into the part of groove 7 adjacent to plate or cap 2.

In an advantageous manner in a third step the assembly is then heated, for example in an oven, to harden the resin when the selected resin does not polymerize at ambient temperature, or polymerizes too slowly.

After hardening of resin 8, one obtains a sealed and reliable connection between body 1 and plate 2.

Preferably, the resin 8 utilized is a silicone resin. Such a resin is resistant to the maximum service temperature of a pressing iron.

Figure 4:
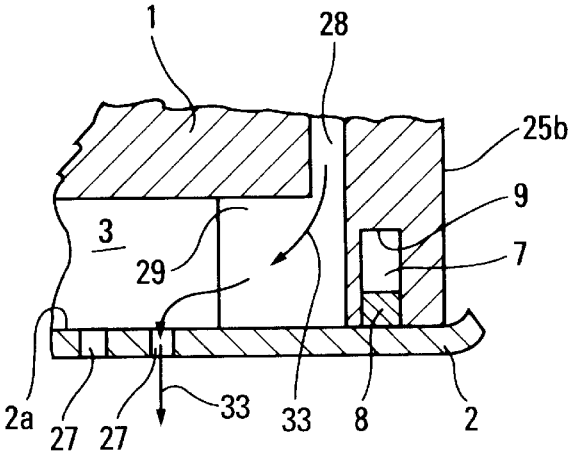
FIG. 4 is a partial cross-sectional view according to line IV—IV of FIG. 3.
Figure 5:
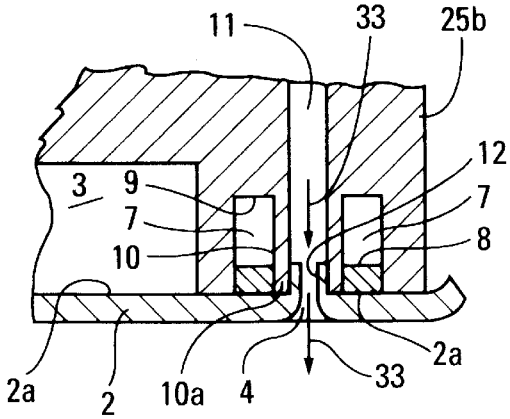
FIG. 5 is a partial cross-sectional view according to line V—V of FIG. 3.
Figure 3:
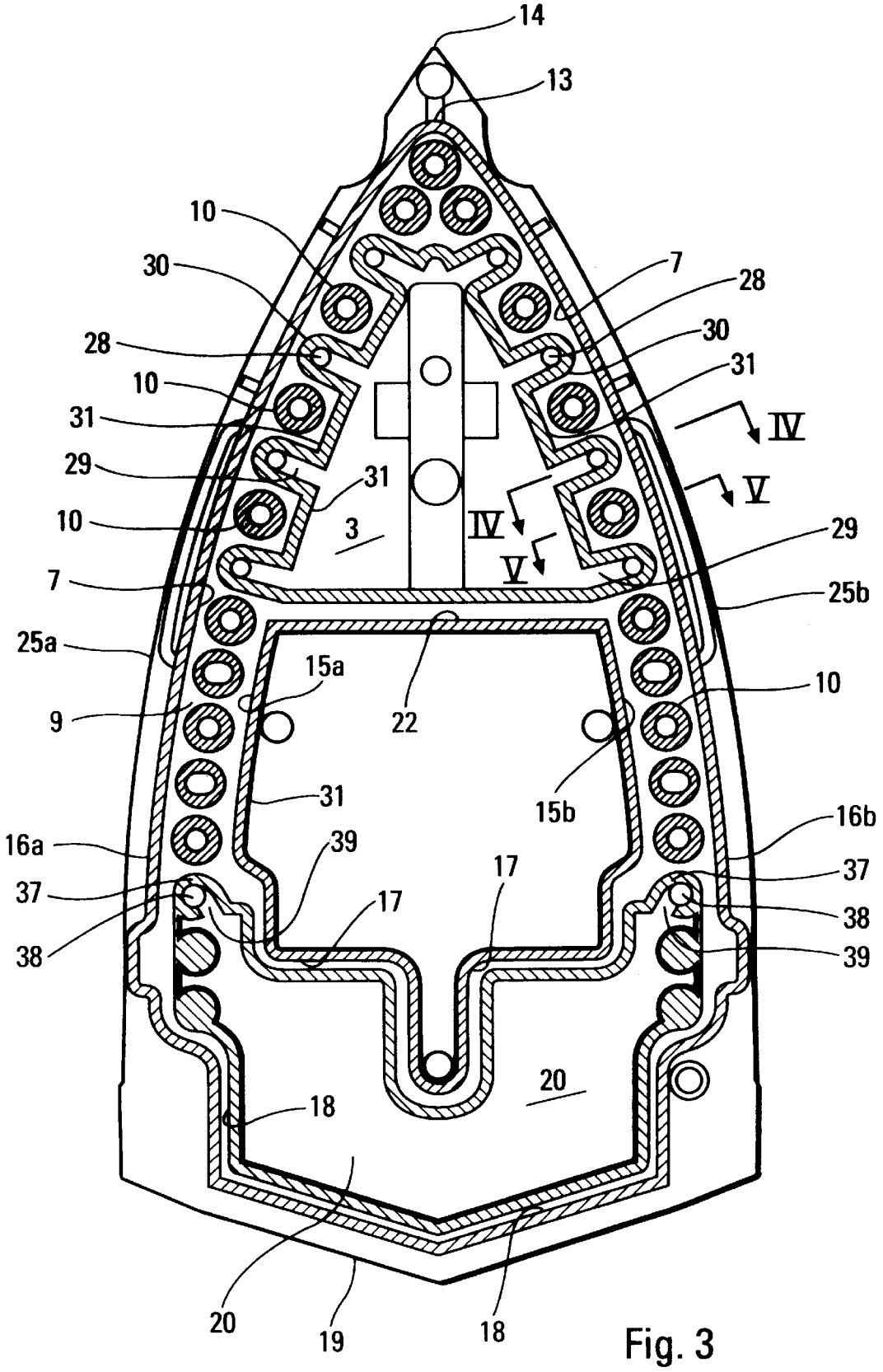
FIG. 3 is a cross-sectional view along line III—III of FIG. 2.

In the example illustrated in FIGS. 3 to 5, each of the branches 15*a*, 15*b* of groove 7 adjacent to respective longitudinal edges 25*a*, 25*b* of heating body 1 is traversed by a series of conduits 10 whose extremity adjacent to the bottom 9 of said branch 15*a*, 15*b* communicates by a channel 11 with steam chamber 26 and the other extremity of which opens into a hole 4 formed in plate 2 applied onto heating body 1, as shown in FIG. 5.

FIG. 5 shows on the other hand that resin 8 poured into groove 7 surrounds the extremity 10*a* adjacent plate 2 of each conduit 10 and is in contact with surface 2*a* of plate 2 which covers groove 7.

One sees on the other hand on FIG. 5 that steam passage holes 4 formed in plate 2 are extended toward heating body 1 by tubular parts 12 formed in plate 2.

In the position shown in FIG. 5, tubular parts 12 are engaged and set into extremities 10*a* of conduits 10 situated in groove 7 of heating body 1.

In the exemplary embodiment of heating body 1 according to FIG. 3, groove 7 has substantially the form of an inverted V whose tip 13 is adjacent the tip 14 of the sole plate and of which the extremity 16*a*, 16*b* of the two branches 15*a*, 15*b* opposite to tip 13 communicates with a groove 17 which connects these two branches 15*a*, 15*b*.

It is seen in FIG. 3 that a groove 22 connects the two branches 15*a*, 15*b* of groove 7 between tip 13 and groove 17.

The heating body 1 presents, between grooves 15*a*, 15*b* and groove 22, a chamber 3 constituting a first steam distribution chamber 3 which is closed by plate 2 and which communicates with the outside via holes 27 arranged in the thickness of plate 2.

The first steam distribution chamber 3 communicates with steam chamber 26 via channels 28 each arranged between two adjacent channels 11 and each ending in the first distribution chamber 3 by a recess 29 formed by a portion 30 in the form of a U opened toward chamber 3 of interior wall 31 of the corresponding branch 15*a*, 15*b* of groove 7.

In the example of FIG. 3, the extremities 16*a*, 16*b* of the two branches 15*a*, 15*b* of groove 7 in the form of an inverted V are connected together by a second groove 18 which extends close to the rear edge 19 of heating body 1.

Figure 6:
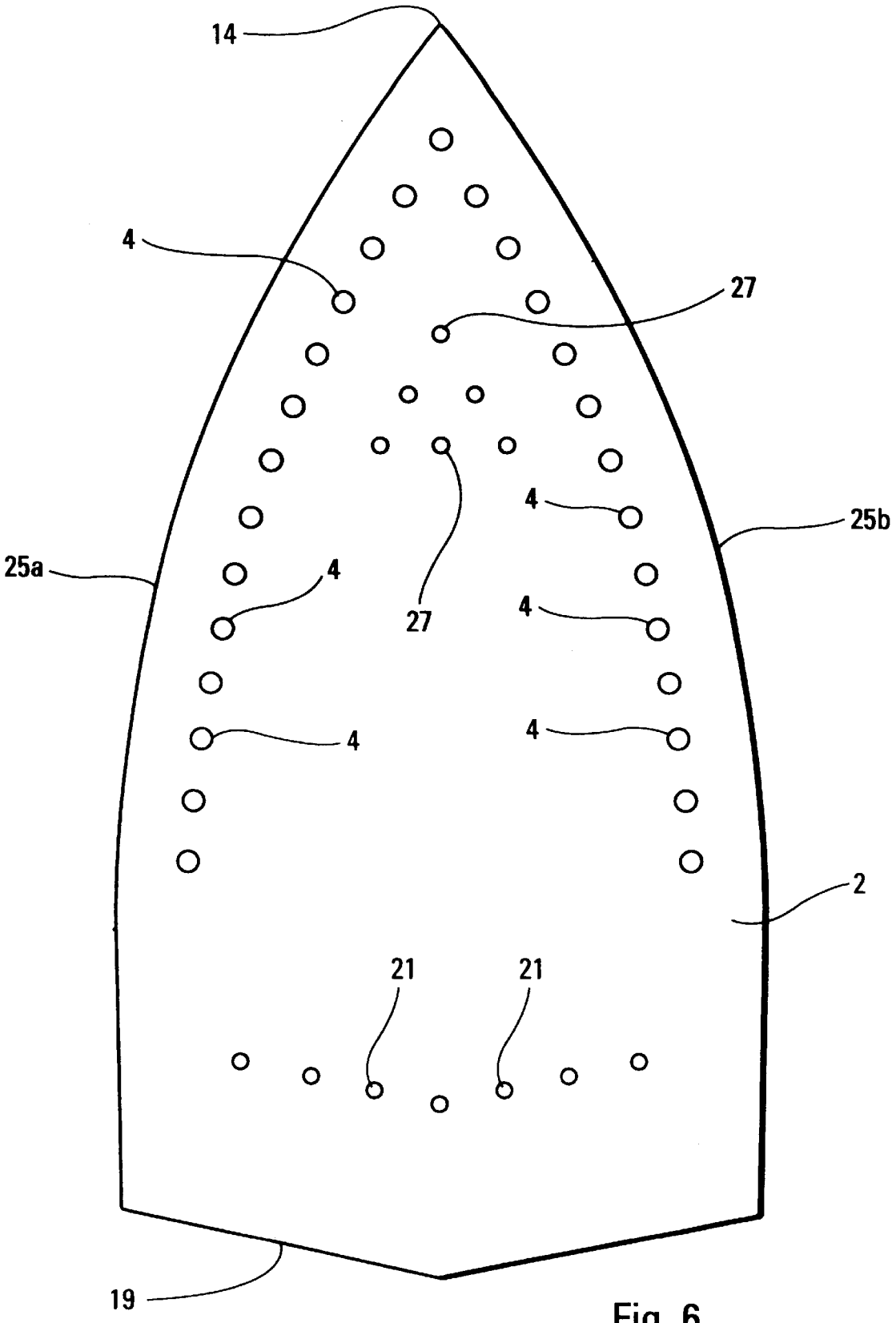
FIG. 6 is a plan view of an embodiment of the ironing side of the plate intended to cover the heating body of FIG. 3.
Figure 7:
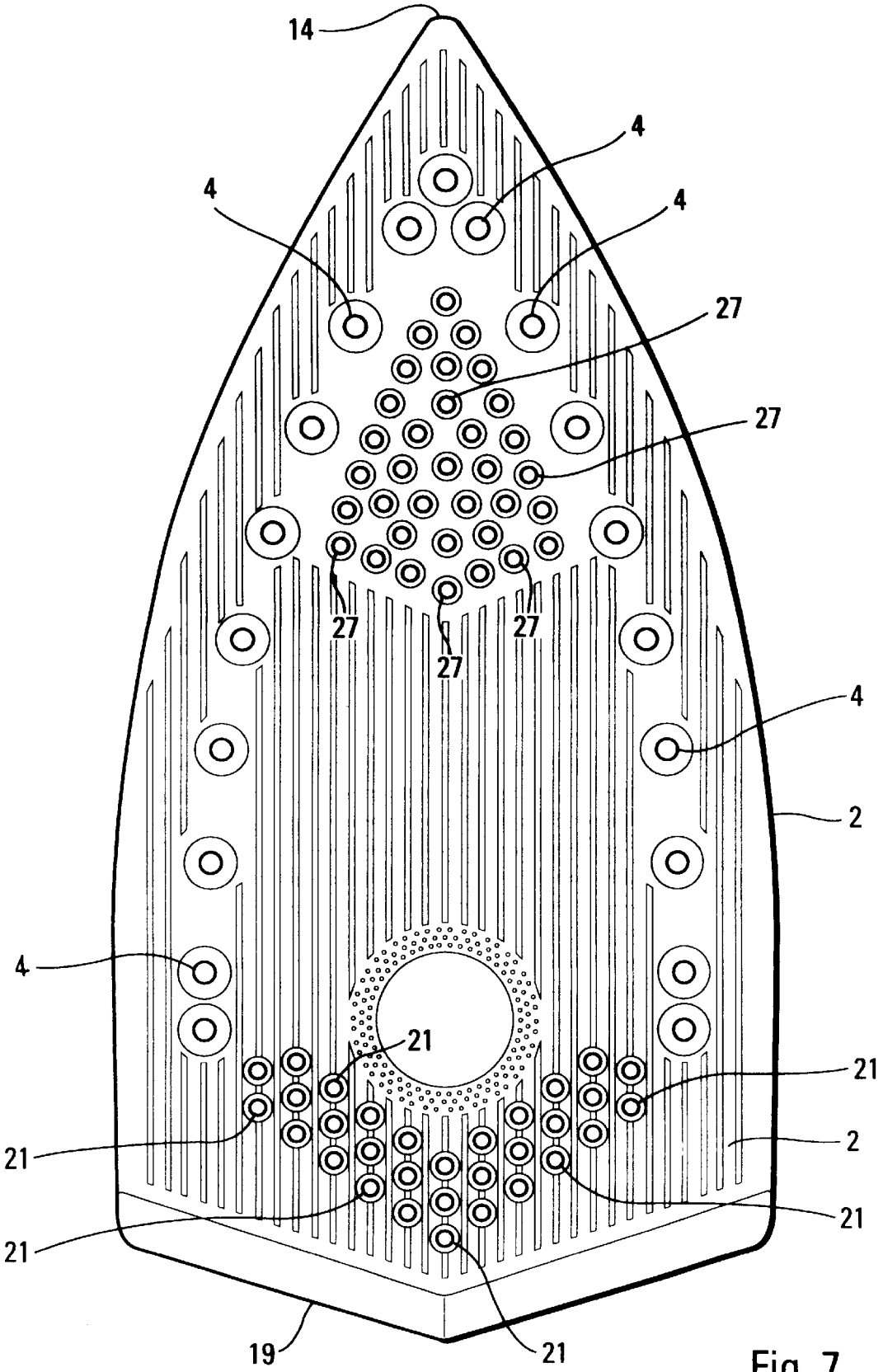
FIG. 7 is a view similar to that of FIG. 6 of another embodiment of the invention.

The two grooves 17, 18 connecting together the extremities 16*a*, 16*b* of the two branches of groove 7 in the form of an inverted V, surround a second steam distribution chamber 20 which opens to the outside via holes 21 formed in the rear part of plate 2 (see FIGS. 6 and 7). The second steam distribution chamber 20 communicates with steam chamber 26 by channels 38 each ending in said second chamber by a recess 39 formed in a portion of a wall 37 delimiting grooves 17, 18 and the second distribution chamber 20.

During pouring of resin 8, heating body 1 is disposed flat as indicated in FIG. 3.

This resin 8 partially fills groove 7 in the form of an inverted V, grooves 17 and 18, as well as the groove 22 which connects the two branches 15*a*, 15*b* of groove 7.

After application of plate 2 on heating body 1, and turning over of the assembly, the resin 8 flows onto the surface of plate 2 which covers the grooves 7, 17, 18 and 22.

After heating and hardening of resin 8, this latter forms a continuous sealed joint, which extends over all of the periphery of plate 2 and of heating body 1, around distribution chambers 3 and 20 and around conduits 10 and steam passage holes 4.

A spout 32 (see FIGS. 1 and 2) places the interior of groove 7 in communication with the outside in order to facilitate this operation.

The resin joint thus obtained, while guaranteeing an excellent and reliable seal, also assures an excellent mechanical connection between heating body 1 and plate 2.

The resin joint thus produced along grooves 7, 15*a*, 15*b*, 17, 18 and 22 thus frees the entire central part of the interior side of heating body 1 and the central part of cap 2, and thus permits the creation of steam distribution chambers such as chambers 3 and 20 described.

Distribution chambers 3 and 20 can be connected to one or more steam chambers different from that supplying channels 10 and holes 4, which permits precise control of the passage of steam through cap 2 toward the fabric to be ironed, by arranging on cap 2 several zones for the arrival of steam constituted respectively by holes 4, 21 and 27. The flow of steam is shown schematically by arrows 33 in FIGS. 4 and 5.

The central zone of cap 2 arranged between these three zones thus constitutes a dry fabric heating zone.

Of course, the invention is not limited to the examples which have been described and one can make numerous modifications thereto without departing from the framework of the invention.

POSSIBILITY OF INDUSTRIAL APPLICATION

The invention finds its application in the field of pressing irons.

What is claimed is:

1. Process for producing a sealed connection between the heating body (1) of a sole plate of a steam iron and a plate (2) constituting the ironing surface of said iron, said plate (2) comprising steam outlet holes (4), characterized in that the side (6) of the heating body (1) intended to be covered by said plate (2) comprises a first groove (7) extending at least along all of the periphery of said heating body, in that said heating body (1) is maintained flat, the side (6) comprising the first groove (7) being directed toward the top, resin (8) is poured into said first groove (7), said plate (2) is applied onto said side (6) of the heating body (1), the assembly is turned over in a manner that the plate (2) is directed toward the bottom, in order to cause the resin (8) to flow into the part of the first groove (7) adjacent to the plate (2).

2. Process according to claim 1, characterized in that the assembly is then heated, in order to harden the resin (8).

3. Process according to claim 1, characterized in that the resin utilized is a silicone resin.

4. A sole plate of a steam iron comprising a heating body (1) and a plate (2) constituting the ironing surface of said iron, a sealed connection being produced between the heating body (1) and the plate (2) characterized in that said sealed connection is produced according to the process in accordance with claim 1.

5. Sole plate according to claim 4, characterized in that: the heating body has a plurality of longitudinal edges (25*a*, 25*b*); said first groove (7) has a plurality of branches (15*a*, 15*b*) each adjacent to a respective one of said longitudinal edges (25*a*, 25*b*) of the heating body (1); each of said branches (15*a*, 15*b*) has a bottom (9); and said sole plate further comprises a series of conduits (10) traversing each of said branches (15*a*, 15*b*), each of said conduits having one extremity adjacent to the bottom (9) of one of said branches (15*a*, 15*b*) and communicating by a channel (11) with a steam chamber (26) and another extremity (10*a*) which opens into a hole (4) formed in the plate (2) applied onto the heating body (1).

6. Sole plate according to claim 5, characterized in that the resin (8) poured into said first groove (7) surrounds the after extremity (10*a*) of each conduit (10) adjacent to the plate (2) and is in contact with the surface (2*a*) of the plate (2) which covers the first groove (7).

7. Sole plate according to claim 5, characterized in that the steam passage holes (4) formed in the plate (2) are extended toward the heating body (1) by tubular parts (12) formed in said plate (2), these latters being engaged and set into the conduits (10) situated in the first groove (7) of the heating body (1).

8. Sole plate according to claim 5, characterized in that: said plurality of branches (15*a*, 15*b*) are composed of two branches; said first groove (7) has substantially the form of an inverted V of which the tip (13) is adjacent to the tip of the sole plate; said two branches extend from the tip of the inverted V and have extremities (16*a*, 16*b*) which are opposite to the tip (13) of the inverted V; and the side (6) of the heating body (1) intended to be covered by said plate (2) comprises a second groove (17) which connects the two branches (15*a*, 15*b*).

9. Sole plate according to claim 8, characterized in that a third groove (22) connects the two branches (15*a*, 15*b*) of the first groove (7) between the tip (13) of the of the inverted V and the second groove (17).

10. Sole plate according to claim 9, characterized in that the heating body (1) presents, between the two branches (15*a*, 15*b*) and the third groove (22), a chamber (3) constituting a first steam distribution chamber (3) which is closed by the plate (2) and which communicates with the exterior by holes (27) formed in the thickness of the plate (2).

11. Sole plate according to claim 10, characterized in that the first steam distribution chamber (3) communicates with the steam chamber (26) by channels (28) each arranged between two adjacent channels (11) and each ending in the first distribution chamber (3) by a recess (29) formed by a portion (30), in the form of a U opened toward the chamber (3), of the interior wall of the corresponding branch (15*a*, 15*b*) of the first groove (7).

12. Sole plate according to claim 8, characterized in that the extremities (16*a*, 16*b*) of the two branches (15*a*, 15*b*) of the first groove (7) are connected together by a fourth groove (18) which extends close to the rear edge (19) of the heating body (1).

13. Sole plate according to claim 12, characterized in that the second and fourth grooves (17, 18) connecting together the extremities (16*a*, 16*b*) of the two branches (15*a*, 15*b*) of the first groove (7) surround a second steam distribution chamber (20) which opens to the exterior through holes (21) formed in the rear part of the plate (2).

* * * * *

UNITED STATES PATENT AND TRADEMARK OFFICE

CERTIFICATE OF CORRECTION

PATENT NO. : 6,125,562

DATED : Oct. 3, 2000

INVENTOR(S) : Dodier et al.

It is certified that error appears in the above-identified patent and that said Letters Patent is hereby corrected as shown below:

Cover page, line [54], delete "METHOD FOR PRODUCING A SEALED CONNECTION BETWEEN THE HEATING BODY OF A SOLE PLATE OF IRON SOLE PLATE" and insert therefor --METHOD FOR PRODUCING A SEALED CONNECTION BETWEEN A STEAM IRON SOLE PLATE HEATING ELEMENT AND A PLATE AND RESULTING IRON SOLE PLATE--;

Cover page, line [87], delete "WO98/11855" and insert therefor --WO99/11855--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*